US007547256B1

(12) United States Patent
Petrie

(10) Patent No.: US 7,547,256 B1
(45) Date of Patent: Jun. 16, 2009

(54) GOLF SWING TRAINER

(76) Inventor: Jerry Ott Petrie, 6404 Talbot Ct., Fort Wayne, IN (US) 46815

( * ) Notice: Subject to any disclaimer, the term of this patent is extended or adjusted under 35 U.S.C. 154(b) by 0 days.

(21) Appl. No.: 12/050,122

(22) Filed: Mar. 17, 2008

Related U.S. Application Data

(60) Provisional application No. 60/918,429, filed on Mar. 17, 2007.

(51) Int. Cl.
*A63B 69/36* (2006.01)

(52) U.S. Cl. ..... 473/212; 473/207; 473/276

(58) Field of Classification Search ..... 473/207, 473/212, 213, 214, 226, 227, 229, 276, 461, 473/464
See application file for complete search history.

(56) References Cited

U.S. PATENT DOCUMENTS 2,189,997 A * 2/1940 Salem ..... 473/461
5,174,575 A * 12/1992 Leith et al. ..... 473/213
5,476,257 A * 12/1995 Bobby ..... 473/464
5,954,598 A * 9/1999 Carlson ..... 473/458
6,471,598 B2 * 10/2002 Takase ..... 473/212
6,827,654 B2 * 12/2004 Meyer ..... 473/212
2005/0202896 A1 9/2005 Burke
2006/0003850 A1 * 1/2006 Marland et al. ..... 473/276

* cited by examiner

*Primary Examiner*—Nini Legesse
(74) *Attorney, Agent, or Firm*—Dorothy S. Morse

(57) ABSTRACT

An apparatus for improving a golf swing that comprises a telescopic arm link shaft connected between a golfer's upper arm and the grip of a golf club held in the golfer's hands. The arcuate grip attachment member of the apparatus is easily held against the golf club grip by the golfer's hands. The shaft-to-grip connection pivots, while the shaft-to-arm-attachment-member connection provides swiveling movement. The arm attachment member can also be adjusted around the golfer's upper arm to provide a comfortable but non-slip connection. A stop on telescopic arm link shaft further allows the golfer to adjust the maximum amount of angle change desired during a golf swing. Thus, angle and rotational changes for the golfer's lower arm are permitted, while absolute alignment of the golfer's upper and lower arms to the golf club is maintained throughout the golf swing. Applications can include any sports implement used with a swinging motion.

20 Claims, 8 Drawing Sheets

FIG. 12
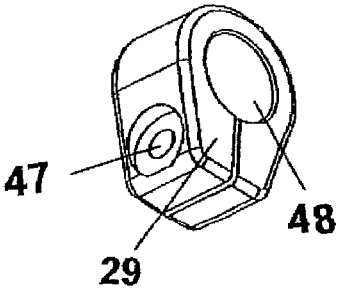
FIG. 13
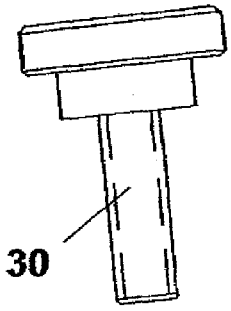
FIG. 14
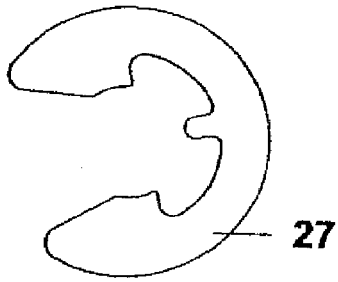
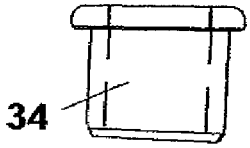
FIG. 15
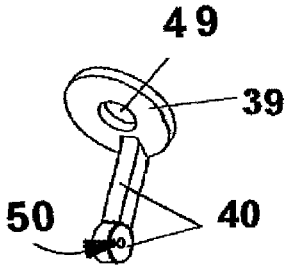
FIG. 16
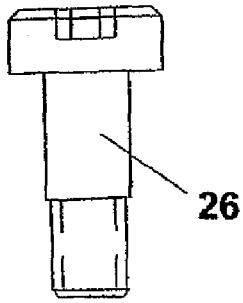
FIG. 17
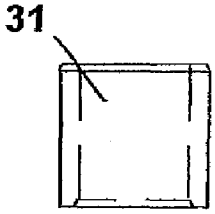
FIG. 18
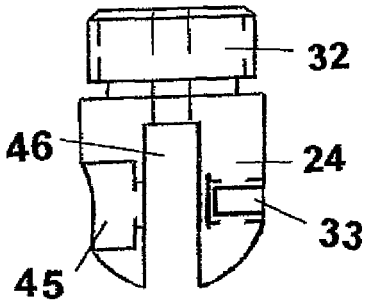
FIG. 19
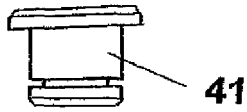
FIG. 20

GOLF SWING TRAINER

CROSS-REFERENCES TO RELATED APPLICATIONS

This application is related to U.S. Provisional Patent Application 60/918,429 with similar subject matter and the same title, which was filed by the same inventor on Mar. 17, 2007. An earlier U.S. provisional patent application was also filed by the inventor herein for subject matter similar to, but more complex than, that in the later-filed provisional patent application 60/918,429, with the earlier-filed provisional patent application being based upon a prototype that provided the inspiration for the inventor's simplified present invention. The earlier provisional patent application was filed on Mar. 6, 2006, entitled "Golf Swing Trainer", and had the Ser. No. 60/770,649. Prior to the earlier-filed provisional patent application, the inventor had also filed a Disclosure Document on Nov. 17, 2004, which had the title of "Golf Swing Plane Trainer" and an assigned U.S. Disclosure Document Reference Number of 565,558.

BACKGROUND

1. Field of the Invention

This invention relates to the field of devices used for instructing and improving the swinging of a sports implement, specifically to an apparatus primarily for instructing and improving the proficiency of swinging a golf club which comprises a telescopic arm link shaft connected on its opposed ends between a flexible arm attachment member (also referred to herein as an armband) that becomes secured to the golfer's upper arm (above the elbow) and a grip attachment member that is placed into contact with, and engages, the golf club grip during a golf swing. However, this invention can also be effectively used to instruct and improve the efficiency of swinging a variety of other sports implements that are employed with a swinging motion similar to that of a golf club as a part of their use. Thus, for thoroughness and conciseness without undue confusion, and further without any intention of limitation, the following description of the present invention will primarily be directed to the golf club application. The grip attachment member attached to one end of the telescopic arm link shaft may be temporarily held by the golfer's hands against the golf club grip, or instead it may be permanently or detachably secured to the grip of a golf club used primarily for training purposes via one or more clamping devices or other fasteners. A non-slip surface texture on the curved surface of the grip attachment member intended for engagement with the outside surface of the golf club grip can be optionally used to provide a high-friction interface that enhances a secure connection between the golf club grip and the present invention while a golf club swing is practiced. The flexible arm attachment member, which is also referred to herein as an armband, is employed to secure the upper end of the telescopic arm link shaft to one arm of the golfer above the elbow, and it comprises an upper arm connector with a bearing that in combination with a diagonally-extending upper arm pivot, as well as the free sliding and rotational movement of the inner arm link tube within the outer arm link tube, allows for a 360-degree swiveling motion of the armband above and around the upper end of the telescopic arm link shaft. For right-handed golfers, the arm attachment member is secured to the left arm, while right arm attachment is needed for left-handed golfers. In the following description most reference is made to right-handed golfers for brevity and to avoid confusion, however, doing so should not be misconstrued as an intentional limitation. Further, the grip attachment member is pivotally connected to the lower end of the telescopic arm link shaft via a grip attachment pivot member and a curved extension. The grip attachment member is arcuately configured for use close against the curved outer surface of a golf club grip, with the grip attachment pivot member being placed at a point on the grip attachment member that consequently establishes an angle between the golfer's connected arm and the shaft of the golf club held by the golfer when the grip attachment member becomes positioned between the golfer's hands and the golf club grip. Then, throughout a golf swing, the present invention will permit angle and rotational changes in the lower portion of the golfer's connected arm (below the elbow), while it simultaneously maintains absolute alignment of the both the golfer's upper and lower arms to the golf club. Freely sliding and rotational movement of the telescopic arm link shaft's inner arm link tube within its outer arm link tube also facilitates a smooth transition for the angle and rotational changes in the golfer's lower arm needed during a golf swing. Thus, the present invention conditions the golfer's arms, wrists, and hands to the proper movements, rhythm, and timing of a quality golf swing. This type of practice and conditioning can be accomplished with or without a golf ball. Other applications, although not limited thereto, are swinging instruction and conditioning relating to baseball, softball, hockey, lacrosse, and the like, which require a player to swing a bat, stick, or other sports implement during at least a portion of the game play, and speed and strength training when a weight is associated with the sports implement or the present invention.

2. Description of the Related Art

Research reveals endless creations to improve the golf swing. These include light sensors, computerized analysis, weighted shafts, off-set shafts, visualization, and double bent shafts. The above creations incorporate very few of the advantages of the present swing trainer invention. Although a few such creations do include a sleeve or armband attached to the arm of a golfer, none also includes a swivel attachment to the golfer's upper arm (above the elbow) and a pivoting structure attached to the grip end of a club held by the golfer, or the freely sliding and rotational movement of an inner arm link tube within an outer arm link tube, whereby as a result of the engagement of the device with a golfer's arm and a golf club grip, absolute alignment of the golfer's upper and lower arms to the golf club held in the golfer's hands is maintained throughout the golf swing.

The invention thought to be the closest to the present invention is that disclosed in U.S. published patent application 2005/0202896 to Burke. The Burke invention includes an armband attached to the top end of a resilient cord that is stretched between the armband and a position on a golf club shaft below the grip determined according to the stature and/or skill level of the golfer. As the golfer moves the club back and forth in either a short or full swing, the stretch in the cord is maintained. However, the structure and function of the present invention are different from that attributable to Burke. Instead of the resilient cord used in the Burke invention, the present invention has a telescopic arm link shaft comprising an inner arm link tube and an outer arm link tube that freely slide and rotate relative to one another during a golf swing, and a pivoting connection between the outer arm link tube and the golf club grip attachment member. Further, even though the resilient cord of Burke at least initially indicates desirable alignment of a golfer's arm to a golf club, due to the flexibility and stretching that occurs in the cord during a golf club swing, the Burke invention is not able to lock in and maintain an absolute alignment of the golfer's arm to the golf club throughout the golf swing, as occurs with the present invention golf swing trainer. No other golf swing training device is known that functions in the same manner or provides all of the advantages of the present invention.

BRIEF SUMMARY OF THE INVENTION

The primary object of this invention is to provide a golf swing training device for instructing and conditioning golfers on a quality and repeatable golf swing, in addition to developing muscle memory for a proper golf club swing when attempted without the swing training device. Another object of this invention is to provide a swing training device that is also usable in instructing and improving players' swings in other sports. It is also an object of this invention to provide a sports implement swing training device that can be permanently incorporated into a practice device, with or without permanent alteration to the sports implement, or in the alternative be manufactured as a device that temporarily engages the outer surface of a favorite club, bat, stick, or other sports implement without any permanent alteration to it, so that after present invention use the sports implement can be used in a game or other competitive activity. It is a further object of this invention to provide a swing training device having durable weatherproof construction and also made from lightweight materials for minimal arm encumbrance. It is also an object of this invention to provide a swing training device with an armband that is adjustable for a non-slip comfortable non-slip fit that accommodates use on different golfers. A further object of this invention is to provide a swing training device wherein the fit and comfort of the armband can be enhanced with one or more permanently attached or detachable foam pads or other inserts. Another object of this invention is to provide a golf swing training device that is simple in design for easy manufacture, and has a minimal number of components for reduced manufacturing cost. It is a further object of this invention to provide a golf swing training device that is also adaptable for strength and speed training.

The present invention, when properly made and used, will provide a golf swing training device which comprises a telescopic arm link shaft having one of its ends configured for pivotally engaging a golf club grip via an arcuate grip attachment member that is secured against the curved outer surface of a golf club grip by the golfer's hands, with the opposing end of the telescopic arm link shaft being configured for swivel connection to one of the golfer's arms (left arm for a right-handed golfer, and vice versa) via an armband of adjustable circumference. The most preferred swivel connection of the armband to the telescopic arm link shaft provides 360-degree swiveling movement of the armband around and above the upper end of the telescopic arm link shaft, which results from the use of an upper arm connector with a bearing in combination with a diagonally-extending upper arm pivot, in addition to the capability of the telescopic arm link shaft's inner arm link tube and outer arm link tube to freely slide and rotate relative to one another. It is preferred for the flexible and adjustable armband to be securely fixed in a non-slip manner to the golfer's upper arm (above the elbow), yet remain comfortable during use, and although not required or limited thereto, it is also preferred for one or more elastic straps, one or more hook-and-loop fasteners, and/or one or more foam pads or other flexible inserts to be optionally used as needed to enhance arm comfort and fit. During the golf swing, the present invention device maintains the golf club held in the golfer's hands and the golfer's upper and lower arms in absolute alignment, while permitting angle and rotational changes in the golfer's lower arm (below the elbow) throughout the golf swing. Thus, use of the present invention conditions the golfer's arms, wrists, and hands to the proper movements, rhythm, and timing of a quality golf swing, so that a quality golf swing becomes customary and habitual even when the golfer attempts to execute it without the present invention. The present invention can be used by a golfer, with or without a golf ball present, and one or more weights can be used at the bottom of the golf club shaft, near the club head, or elsewhere, as needed for strength and speed training. The preferred materials used for manufacture of the present invention are lightweight so that the golfer is able to experience a quality swing with minimal arm encumbrance, with materials and construction sufficiently durable for outdoor use, and the present invention swing trainer further has a simplified design that reduces labor and material cost.

Thus, important advantages of the present invention include:

(a) constant practice with the combined swiveling armband, telescopic shaft, and pivoting grip attachment member will condition the golfer using it to the proper coordinated sequence of arm, wrist and hand actions necessary to efficiently swing a golf club;

(b) the golfer may use the present invention with any of the golfer's own golf clubs and hit shots while the grip attachment member of the apparatus is temporarily held by the golfer's hands against the grip of selected golf clubs one-at-a-time, with the grip attachment member being effectively used in a position under the golf club grip, on top of the golf club grip, or otherwise positioned on the grip according to user preference;

(c) when a golfer's hands are used to hold the grip attachment member against the gold club grip, the most preferred present invention apparatus is removable after use without any damage, modification, or permanent alteration to the golf club or its grip, although permanent or indefinite attachment to a golf club or other sports implement with one or more clamping devices or other fastening means is also considered to be within the scope of the present invention;

(d) the apparatus has an adjustable stop on its telescopic arm link shaft that permits differing angle changes for use with golfers of differing size, stature, and skill level;

(e) the apparatus holds a golf club and the golfer's upper and lower arms in absolute alignment during a golf swing;

(f) The invention conditions all arm, wrist and hand movement in concert, so that the learning is direct and not theoretical;

(g) The apparatus is configured to be easily and rapidly secured against, and disengaged from, a golf club grip and the user's upper arm;

(h) The invention is light in weight and small for minimal arm encumbrance, although it can be weighted for strength and speed training which would insure proper swing mechanics while conditioning;

(i) the golfer may practice his or her swing without hitting golf balls, knowing that the proper timing and mechanics of the swing are still being conditioned;

(j) the invention may be permanently and/or indefinitely attached to a selected golf club primarily intended for practice;

(k) the apparatus is compact and can be easily transported by a golfer; and (l) the apparatus can be easily connected via adaptive connectors to other athletic implements that are swung.

The learning principal of the present invention relates to the golfer and golf club as a set of training wheels relates to a cyclist and a bicycle. Proper practice with the present invention swing trainer will condition the golfer to both the mechanics and the "feel" of an efficient golf swing, which will carry over when the swing trainer is removed. However, if further conditioning is desired at a subsequent time, the present invention swing trainer may be quickly and easily used again at any time with the same or a different golf club or sports implement.

The description herein provides preferred embodiments of the present invention but should not be construed as limiting its scope. For example, variations in the length and diameter dimensions of the inner and outer arm link tubes, the perimeter shape and thickness dimension of the flexible armband, the material from which the armband is made, the configuration of the swivel connection between the armband and the top end of the inner arm link tube, and the manner in which the armband is adjustably secured to the arm of a golfer or the arm of any other sports player needing swing conditioning, other than those shown and described herein, may be incorporated into the present invention. Thus, the scope of the present invention should be determined by the appended claims and their legal equivalents, rather than being limited to the examples given.

BRIEF DESCRIPTION OF THE DRAWINGS

FIG. 12 is a perspective view of an adjustable stop used as a part of the most preferred embodiment of the present invention on the inner arm link tube by the golfer to limit the maximum amount of angle change desired between the golfer's lower arm and the golf club held in the golfer's hands during a golf club swing.

FIG. 13 is a side view of the thumb screw used as a part of the most preferred embodiment of the present invention to tighten the adjustable stop in FIG. 12 into a golfer-selected position on the inner arm link tube.

FIG. 14 is a top view of a retaining clip used as a part of the most preferred embodiment of the present invention to secure the upper arm attachment pin in place which assists in providing a 360-degree swivel connection between the armband and the upper end of the telescopic arm link shaft.

FIG. 15 is a side view of a flange bearing used as a part of the most preferred embodiment of the present invention at the position where the inner arm link tube enters the outer arm link tube.

FIG. 16 is a side view of the upper arm connector with bearing shown in FIG. 6 secured to the armband, with the upper arm pivot also shown in FIG. 6 extending diagonally from one face of the upper arm connector.

FIG. 17 is a side view of the pivot pin used as a part of the most preferred embodiment of the present invention to secure the upper end of the inner arm link tube to the upper arm pivot, and which may have a similar size and/or configuration to the shoulder screw used to secure the grip attachment pivot member to the lower end of the outer arm link tube.

FIG. 18 is a side view of the sleeve bearing used as a part of the most preferred embodiment of the present invention to keep the lower end of the inner arm link tube from passing beyond the flange bearing in FIG. 15 and exiting the top end of the outer arm link tube.

FIG. 19 is a side view of the pivot member and its threaded end used as a part of the most preferred embodiment of the present invention for providing a pivoting connection between the grip attachment pivot member and the lower end of the telescopic arm link shaft, which may have a similar size and/or configuration to the inner arm link tube pivot member used to connect the upper arm pivot to the telescopic arm link shaft.

FIG. 20 is a side view of the upper arm pivot pin used as a part of the most preferred embodiment of the present invention with the retaining clip in FIG. 14 to secure the upper arm connector with bearing to the armband and assist in providing a 360-degree swiveling connection for the armband in all directions substantially around and above the upper arm link tube.

LIST OF COMPONENT NUMBERS

Figure 1:
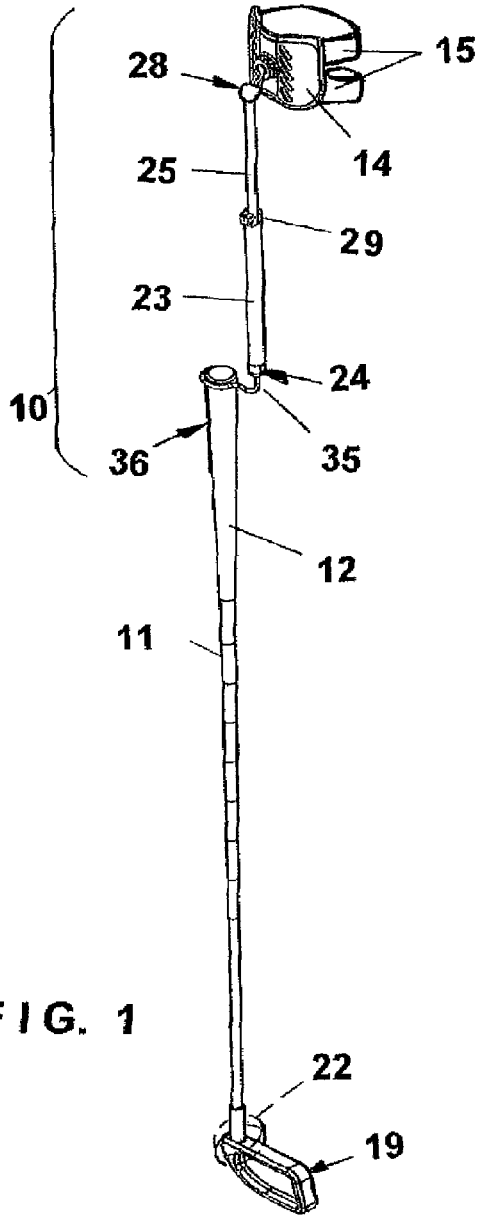
FIG. 1 is a perspective view of the complete assembly of most preferred embodiment of the present invention attached to the grip of a right-handed golf club, with its arm attachment member in a closed configuration and a swing weight used for golfer strength and speed training shown in a preferred position of use near the bottom of the golf club shaft.

10 present invention golf swing training apparatus (also "golf swing trainer", "swing trainer", and "apparatus 10")
11 golf club (one usable in a golf game or primarily used as a practice club)
12 golf club grip
13 golfer's upper arm (above the elbow)
14 armband (also "arm attachment member")
15 flexible armband strap
16 golfer
17 golf ball
18 golfer's lower arm (below the elbow)
19 golf club face
20 telescopic arm link shaft
21 hook-and-loop fastener
22 swing weight (used for speed and strength training of golfer 16)
23 outer arm link tube
24 outer arm link tube pivot member
25 inner arm link tube
26 pivot pin (for securing inner arm link tube pivot member 28 into a pivoting connection)
27 retaining clip
28 inner arm link tube pivot member
29 inner arm link shaft adjustable stop (adjusted by golfer 16 to limiting the maximum amount of the angle change desired between a golfer's lower arm and the golf club held in the golfer's hands during a golf swing)
30 thumb screw (for securing stop 29 in a golfer-selected position on inner arm link tube 25)
31 sleeve bearing (secured to the lower end of inner arm link tube 25 to prevent inner arm link tube 25 from becoming passing beyond flange bearing 34 and exiting outer arm link tube 23)
32 threaded end of outer arm link pivot member 24 (with inside threads for connection to inner arm link tube 25 and outside threads for connection to outer arm link tube 23)
33 pivot pin hole (at the opposite ends of telescopic arm link shaft and configured for use with a shoulder screw 37 or a pivot pin 26)
34 flange bearing (positioned where inner arm link tube 25 enters outer arm link tube 23 to allow freely sliding and rotational movement of inner arm link tube 25 within outer arm link tube 23)
35 curved extension (depends between grip attachment member 36 and grip attachment pivot member 38)
36 golf club grip attachment member (with curvature conforming to curved surface of a golf club grip to provide a close engagement of a grip attachment member to the golf club grip)
37 shoulder screw
38 grip attachment pivot member
39 upper arm connector (with a bearing connection that in combination with diagonally-extending upper arm pivot permits smooth rotation in the pivoting, swivel, and rotational connections of apparatus 10 to provide a smooth transition between the downswing of golf club 11 and the follow-through of golfer 16)
40 upper arm pivot (extending diagonally from upper arm connector 39 to create a swivel (castor effect) connection which results in a smooth directional transition of the golf club on the down swing while the proximal/grip end 12 of golf club 11 points forward into the direction of the golf swing. Then, during the golfer's follow-through, when the proximal/grip end 12 of golf club 11 reverses direction and is caused to point away from the direction of the golf swing, the swivel/castor effect provided by components 39 and 40 also positively influence this reversal of direction and permit it to undergo a smooth transition, wherein the upper arm connector 39 mirrors the lower arm 18 rotation, as well as the angle changes caused by the up and down breaking of the golfer's wrist.)
41 upper arm pivot pin
42 non-skid textured engagement surface of grip attachment member 36 (can comprise integral texture, applied tape or other adhesive-backed material, a sprayed coating, or other common means of providing texture)
43 armband foam pad (also "insert")
44 optional design element (also can incorporate cutout areas used to reduce material cost)
45 inset area for recessed positioning of shoulder screw 37
46 channel/slot for positioning of grip attachment pivot member 38 while it is secured in a pivoting connection via shoulder screw 37
47 fastener hole through adjustable stop 29 (for insertion of thumb screw 30)
48 aperture through adjustable stop 29 (through which inner arm link tube 25 is inserted)
49 pivot pin hole through upper arm connector 39 (for insertion of upper arm pivot pin 41)
50 bore through the distal end of upper arm pivot 40 (through which inner arm link tube pivot pin 26 in FIG. 17 is inserted, with pivot pin 26 also being inserted through the pivot pin hole 33 in inner arm link tube pivot member 28)

DETAILED DESCRIPTION OF PREFERRED EMBODIMENTS

Figure 10:
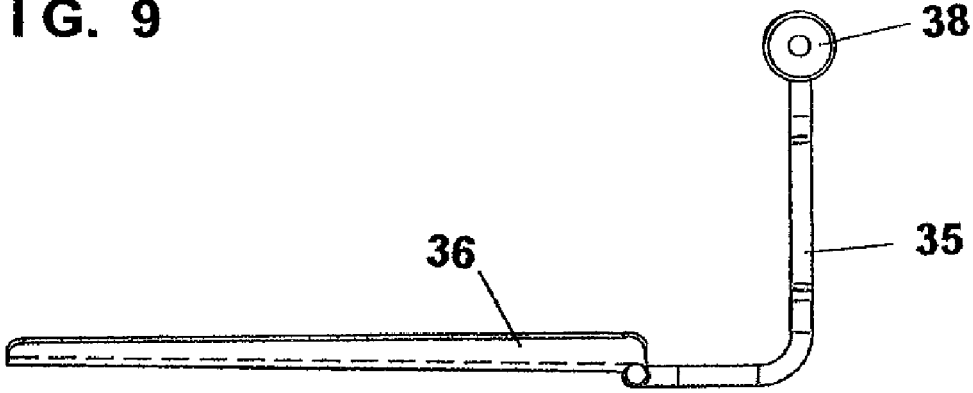
FIG. 10 is a side view of the grip attachment member, curved extension, and grip attachment pivot member shown in FIG. 8.
Figure 11:
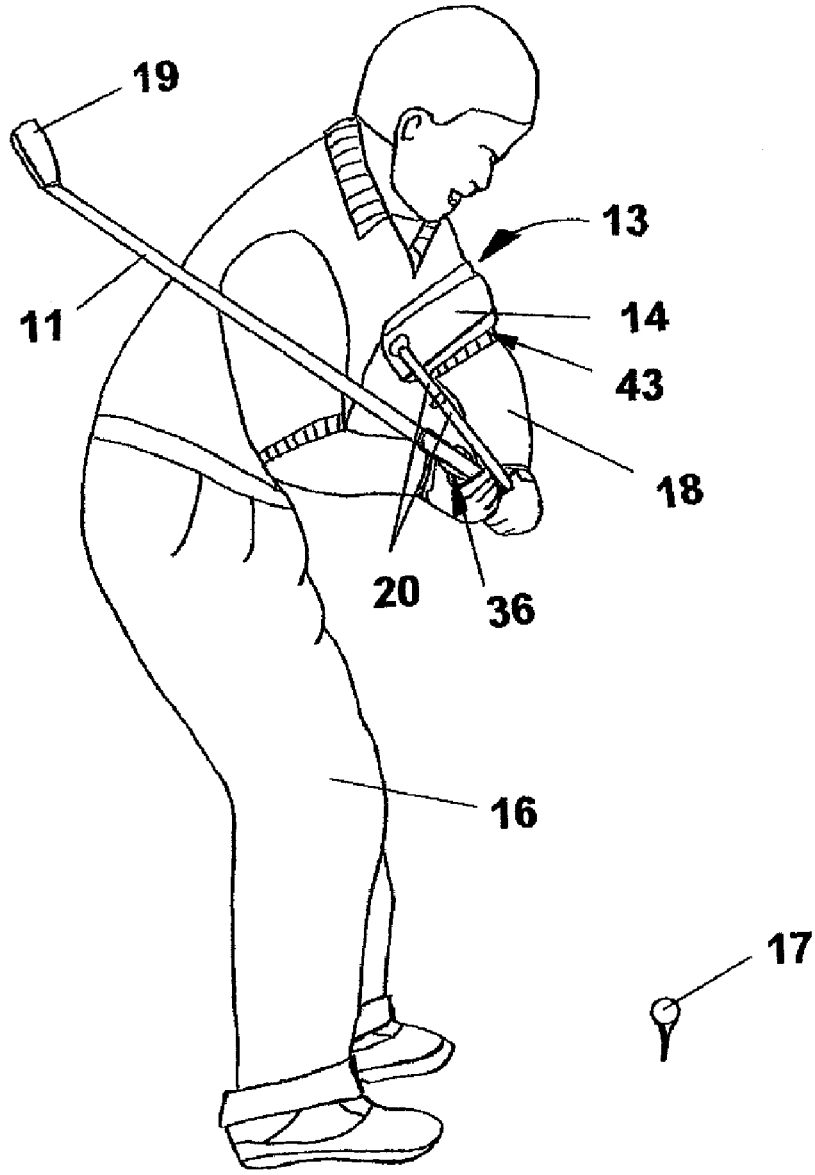
FIG. 11 is a perspective view of the telescopic arm link shaft in the most preferred embodiment of the present invention connected between the upper arm of a golfer and the grip of a golf club, and the golfer addressing a golf ball on a tee with the golf club raised rearwardly to a mid-swing position.

FIGS. 1-21 show the various components of the most preferred embodiment of golf swing training apparatus 10 (hereinafter also referred to as apparatus 10, or golf swing trainer 10). As shown in FIG. 11, apparatus 10 is connected to the upper arm 13 (above the elbow) of a golfer 16 by a size-adjustable armband 14, and is also connected to the grip 12 of the golf club 11 via engagement of an outer arm link tube pivot member 24 with a grip attachment pivot member 38 (hereinafter also referred to as "pivoting connection 24/38" or "pivot 24/38") that depends from one end of an arcuate grip attachment member 36 configured for close positioning against the curved outer surface of a golf club grip 12 by a golfer's hands, or in the alternative by use of permanent or temporarily detachable fastening means (not shown), such as but not limited to a securely fastened but readily releasable clamp. Apparatus 10 permits angle and rotational changes in the lower arm 13 (below the elbow) of a golfer 16 while maintaining absolute alignment of the golfer's upper arm 13 and lower arm 18 to the golf club 11 held in the golfer's hands throughout the golf swing. Although other sports equipment is not shown in the accompanying illustrations, it is also contemplated for apparatus 10 to be connected to bats, sticks, and other sports implements that a user must swing in competitive sports such as, but not limited to, baseball, softball, lacrosse, and hockey. An adapter (not shown) may be required for use of grip attachment member 36 to other sports implements to make certain a secure and close engagement is achieved between it and the outer surfaces of the other sports equipment (not shown). One should recognize that some of the illustrations herein are not strictly to scale, and only generally represent the preferred structure, proportion, and placement of present invention components. Thus, the illustrations herein should not be relied upon for determining the relative size or exact configuration of such components, or any size and/or configuration limitations, and instead the scope of the present invention should be determined by the appended claims and their legal equivalents, rather than being limited to the examples given.

Figure 3:
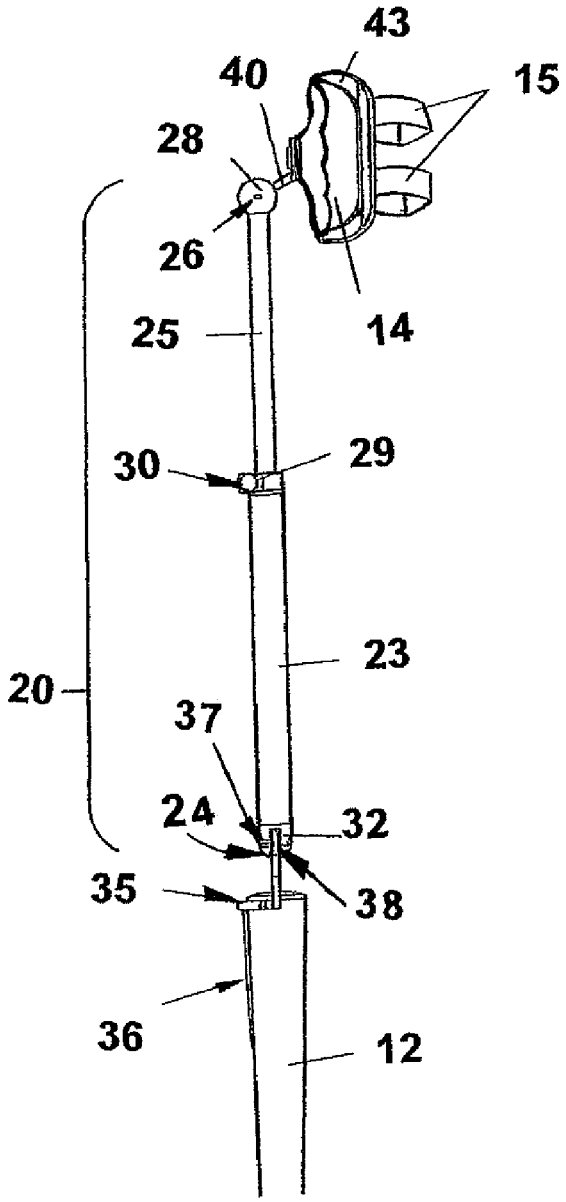
FIG. 3 is a front view of the most preferred embodiment of the present invention attached to a golf club grip and rotated 90-degrees in a clockwise direction around line A-A, with the straps of the arm attachment member in a closed configuration and the grip attachment member almost entirely hidden behind the golf club grip.
Figure 4:
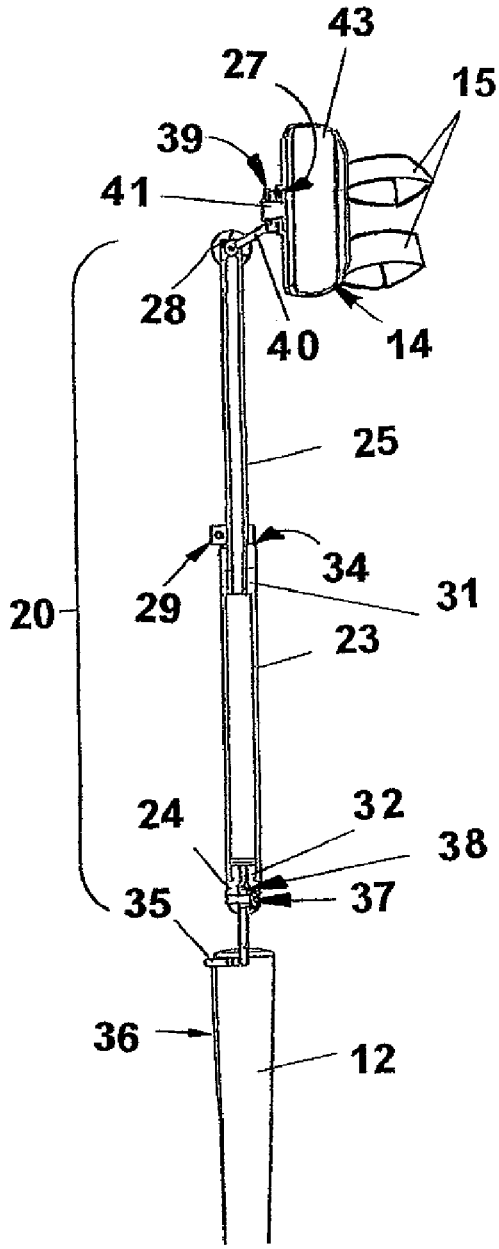
FIG. 4 is a sectional view of the arm attachment member and the telescopic arm link shaft shown in FIG. 3, with the straps of the arm attachment member remaining in a closed configuration and the grip attachment member positioned substantially behind the golf club grip.
Figure 5:
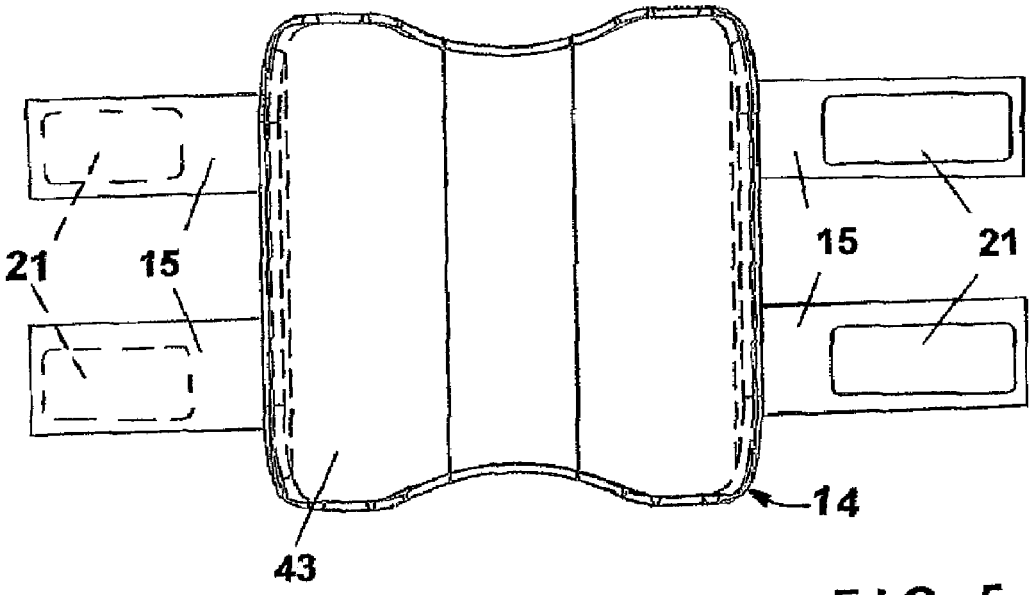
FIG. 5 is a back view of the arm attachment member used as a part of the most preferred embodiment of the present invention, with a foam pad/insert covering most of its inside surface, a two-part adjustable strap structure, and the flexible straps having preferred hook-and-loop closure, with broken lines indicating a hook-and-loop closure member on the reverse side of the associated strap.
Figure 6:
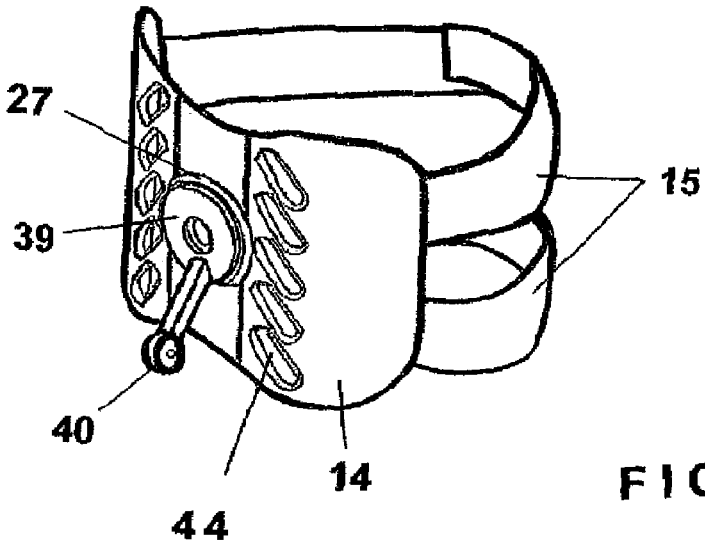
FIG. 6 is a perspective view of the arm attachment member used as a part of the most preferred embodiment of the present invention, with its flexible straps in a closed configuration, no pad/insert visible, and the upper arm pivot, diagonally-extending swivel connector, and retaining clip used as a part of the 360-degree swivel connection between arm attachment member to the upper end of the telescopic arm link shaft shown in their preferred positions of use, with the arm attachment member also shown having an optional design capable of incorporating cutout areas to reduce manufacturing cost.
Figure 7:
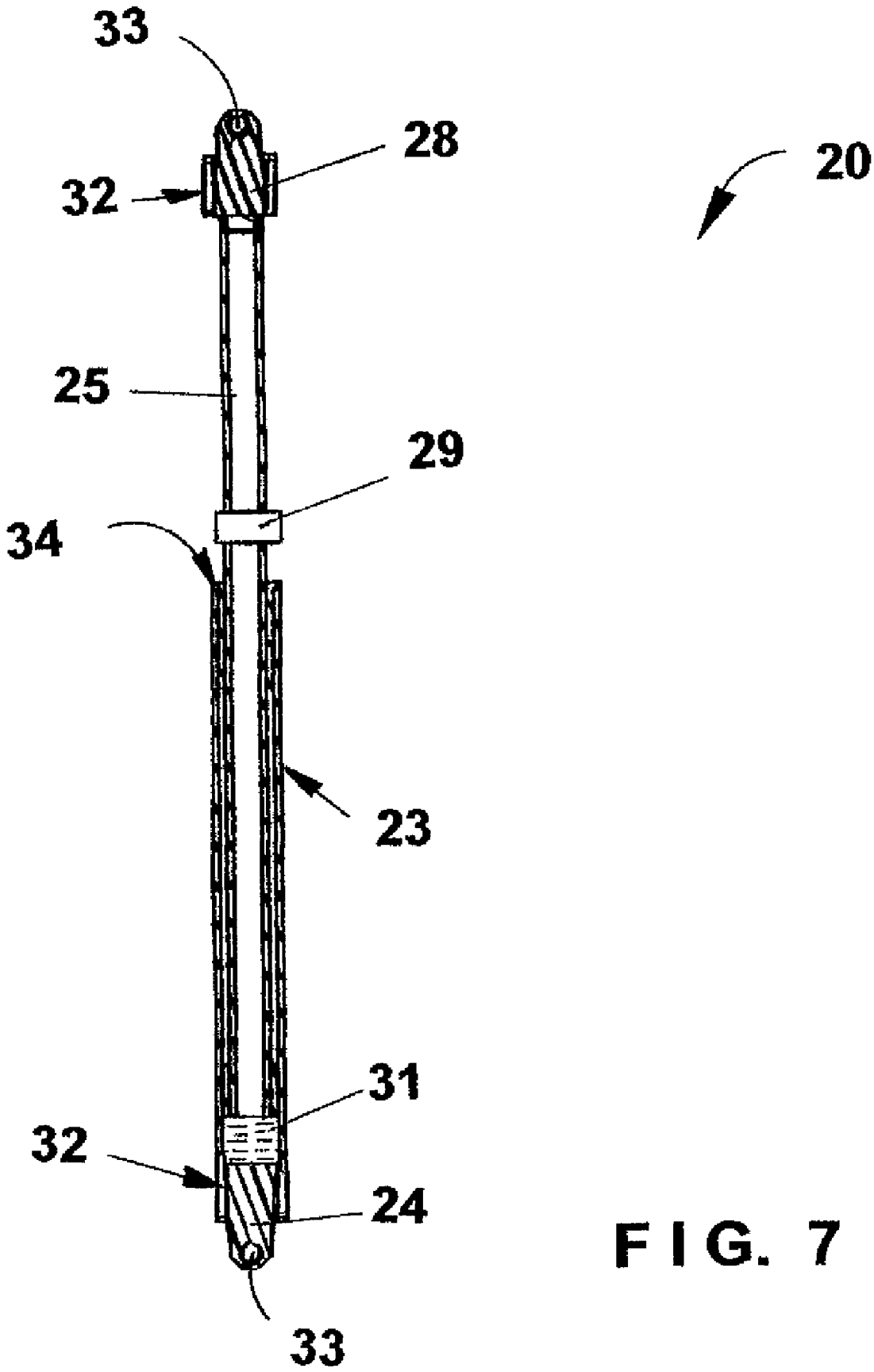
FIG. 7 is a sectional view of the telescopic arm link shaft used as a part of the most preferred embodiment of the present invention, with the inner arm link tube connected for freely sliding and rotational movement within the outer arm link tube, a centrally located adjustable stop that can be preset by the golfer to a selected location on the inner arm link tube via a thumb screw shown in other illustrations, and opposing pivot members each having a pivot pin hole therethrough shown at the opposite ends of the telescopic arm link shaft.
Figure 8:
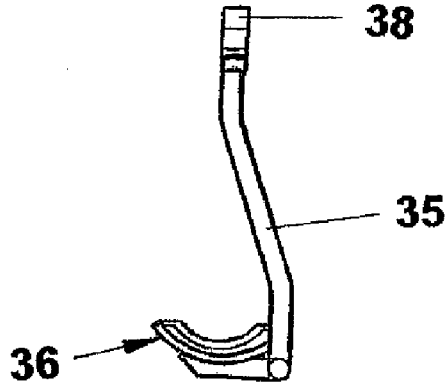
FIG. 8 is an end view of the grip attachment member used as a part of the most preferred embodiment of the present invention, with its near end connected via a curved extension to a grip attachment pivot member.
Figure 9:
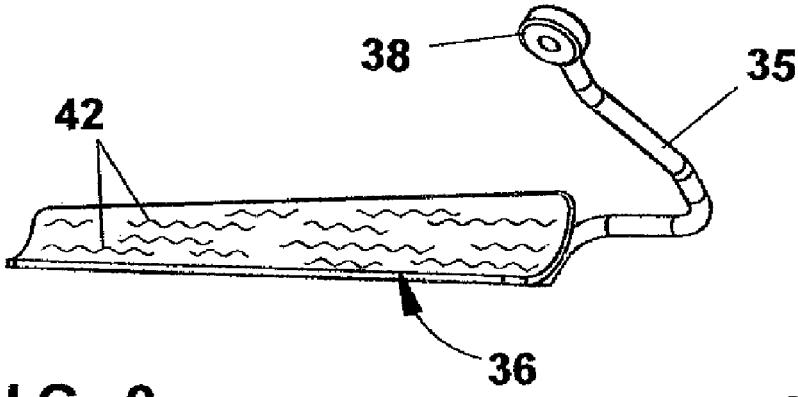
FIG. 9 is a top view of the arcuate surface of the grip attachment member in FIG. 8 intended for engagement with the curved outer surface of a golf club grip, and the arcuate surface having a non-skid surface texture usable for providing an enhanced high-friction engagement between the grip attachment member and the golf club grip when both are held together by the hands of a golfer.
Figure 21:
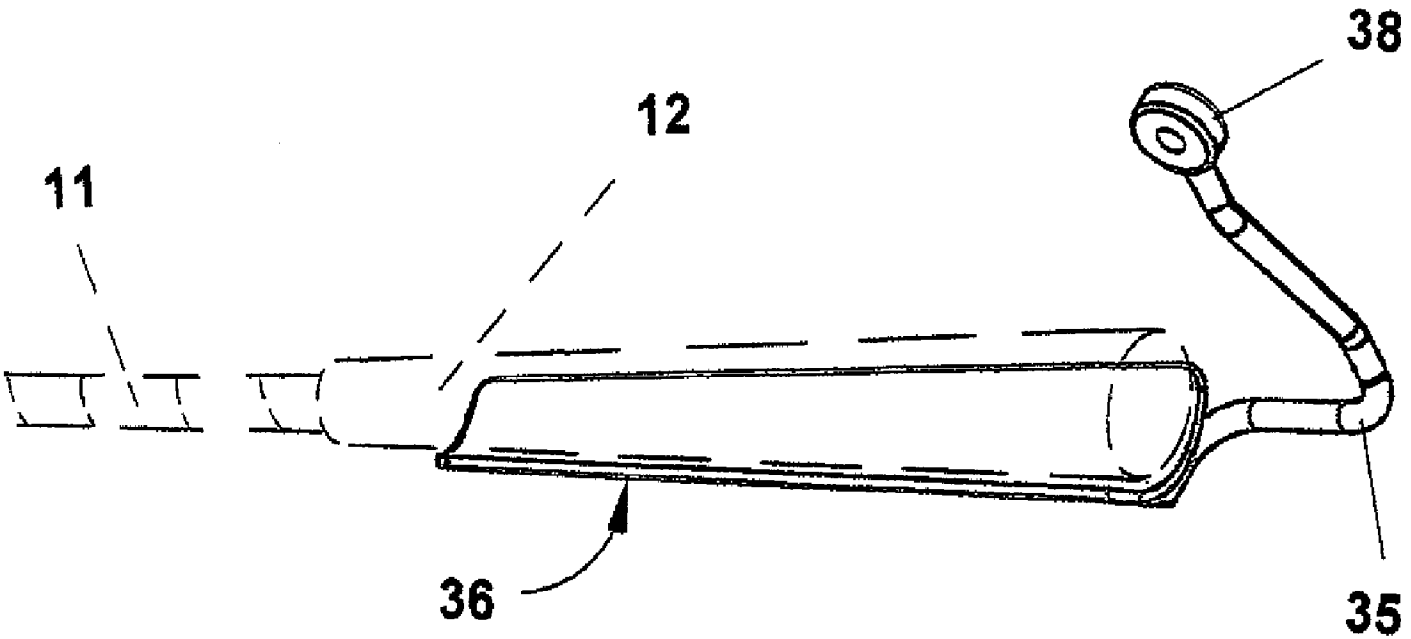
FIG. 21 is a side view of one example of preferred positioning for the grip attachment member used as a part of the most preferred embodiment of the present invention relative to a golf club grip.

FIGS. 1-4 show the complete assembly of apparatus 10 comprising a telescopic arm link shaft 20 connected between an armband 14 and a grip attachment member 36, while FIGS. 5 and 6 show an enlarged armband 14 from differing vantage points. FIG. 7 shows an enlarged view of telescopic arm link shaft 20 with end configurations that assist in providing pivoting connections at each of its ends, and FIGS. 8-10 show more detail about the preferred configuration of the grip attachment member 36 and grip attachment pivot member 38, as well as the curved extension 35 connecting them to one another. As mentioned before, FIG. 11 shows a golfer 16 using the present invention with a golf club 11, while FIGS. 12-20 show enlargements of pivoting, swivel, and rotation-facilitating components in the most preferred embodiment of the present invention that were not identified in sufficient detail in other illustrations for a complete understanding of their structure. Lastly, FIG. 21 shows a grip attachment member 36 engaging a golf club grip 12.

Figure 2:
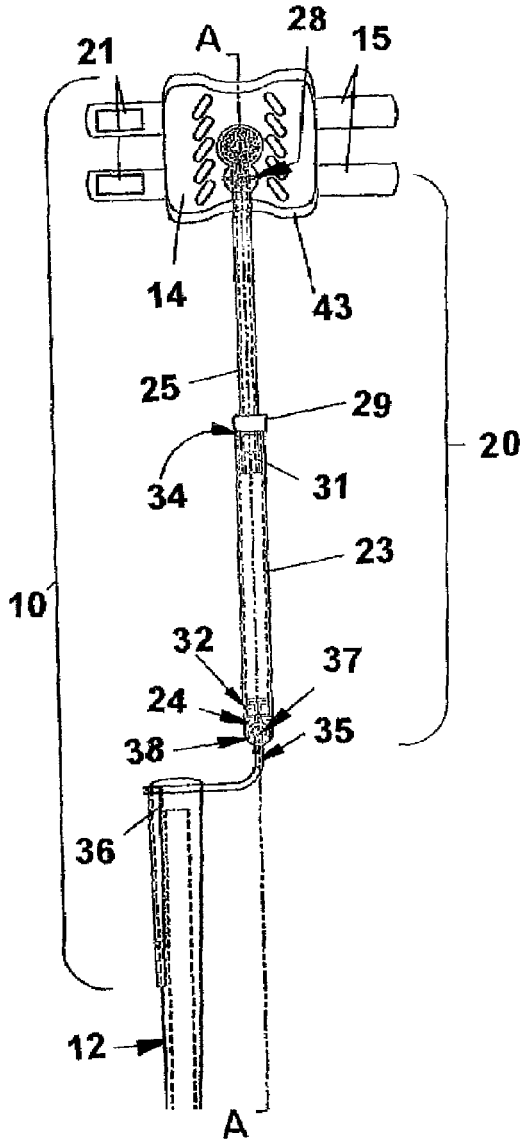
FIG. 2 is a right side view of the most preferred embodiment of the present invention attached to a golf club grip, with the straps of the arm attachment member in an open configuration ready to encircle a golfer's upper arm (above the elbow) and revealing preferred hook-and-loop closure, and further with the centrally located telescopic arm link shaft having broken lines that identify internal structure and a vertically-extending line A-A centrally through telescopic arm link shaft and armband.

The complete assembly of the most preferred embodiment of golf swing training apparatus 10 is illustrated in FIGS. 1-4, which show a telescopic arm link shaft 20 having an inner arm link tube 25 and an outer arm link tube 23, with the lower end of inner arm link tube 25 positioned within outer arm link tube 23 so that each freely slides and rotates relative to the other, and also with the upper end of telescopic arm link shaft 20 connected via a swiveling connection to an armband 14, while the opposing end of telescopic arm link shaft 20 is connected via pivoting connection 24/38 to a golf club grip 12. FIG. 1 shows apparatus 10 attached to a right-handed golf club 11 with golf club face 19 hidden from view, while FIGS. 2-4 show apparatus 10 attached to a golf club grip 12 via grip attachment member 36, grip attachment pivot member 38, and curved extension 35. In addition, FIG. 2 shows apparatus 10 as viewed from the right side, while FIGS. 3 and 4 show apparatus 10 as viewed from the front and rotated approximately 90-degrees from the orientation shown in FIG. 2. The telescopic arm link shaft 20 that is connected to the grip 12 of a golf club 11, via a pivoting connection 24/38 (as shown in FIGS. 1-4), permits angle and rotational changes of the lower arm 18 of a golfer 16 during a swing of golf club 11, while inhibiting alignment variances between the upper arm 13 of golfer 16 (shown in FIG. 11), the lower arm 18 of golfer 16, and the shaft of golf club 11. FIGS. 1-4 also show the swivel connection between the upper end of the telescopic arm link shaft 20 and arm attachment member 14 (or armband 14) in the most preferred embodiment of the present invention, which comprises inner arm link tube pivot member 28, diagonally-extending upper arm pivot 40, upper arm connector with bearing connection 39, retaining clip 27, and upper arm pivot pin 41, most of which are shown in enlarged view in the illustration displaying FIGS. 12-20, except inner arm link tube pivot member 28 which has the option of a pivoting configuration similar to that of pivot member 24, or a configuration providing swiveling movement. Either configuration for inner arm link tube pivot member 28 will effectively complement the other components of the present invention so that a swiveling movement is provided between armband 14 and the upper end of telescopic arm link shaft 20. Upper arm pivot 40 extends diagonally from upper arm connector 39 to create a swivel (castor effect) connection which results in a smooth directional transition of the golf club 11 on the down swing while the proximal/grip end 12 of golf club 11 points forward into the direction of the golf swing. Then, during the follow-through of golfer 16, when the proximal/grip end 12 of golf club 11 reverses direction and is caused to point away from the direction of the golf swing, the swivel/castor effect provided by diagonally-extending upper arm pivot 40 and upper arm connector 39 also positively influences this reversal of direction and permit it to undergo a smooth transition, wherein as a result thereof the upper arm connector 39 effectively mirrors the rotation of lower arm 18, as well as the angle changes caused by the up and down breaking motion of the wrists of golfer 16 during a golf swing. Apparatus 10 is not limited to use with a particular type of golf club 11, and golfer 16 can attach apparatus 10 to any golf club 11 for which golfer 16 needs swing improvement. The advantage of using the exact club 11 in practice that golfer 16 will later use in play provides a great benefit to golfer 16. Further, as another potential application, while golfer 16 may have a confident swing with several favorite clubs 11, he or she may have other less-used clubs 11 and obtain benefit from swing training apparatus 10 during their use. The straps 15 used to adjustably secure armband 14 to the upper arm 13 (above the elbow) of a golfer 16 are also shown in FIGS. 1-4, with FIG. 2 showing the preferred hook-and-loop 21 closure. Other fasteners providing for quick attachment and release of armband 14 from around the upper arm 13 of a golfer 16 can alternatively be used, or used in combination with hook-and-loop fasteners 21. While FIGS. 1-4 show two straps 15 connected to armband 14, it is not contemplated for the number of straps 15 to be limited to two. Further, the number, perimeter configuration, placement, and size of the hook-and-loop fasteners 21 used are also not limited to that shown in FIGS. 1-4. FIGS. 2-4 also show an optional foam pad/insert 43 that can be used with armband 14 to enhance a secure and comfortable fit of armband 14 around the upper arm 13 of a golfer 16. The materials used for insert/pad 43, its perimeter configuration, its thickness dimension, the number of layers it comprises may vary. However, lightweight construction is desired to reduce encumbrance on the connected arm of golfer 16. Further, although the use of foam for insert/pad 43 is preferred, it is not critical.

In addition, FIGS. 1-4 show an adjustable stop 29 connected to inner arm link tube 25. The thumb screw 30 (best shown in FIGS. 3 and 13) is tightened to secure stop 29 in a golfer-selected pre-set position on inner arm link tube 25. Stop 29 is used to limit the maximum amount of the angle changes desired between the lower arm 18 of golfer 16 and the golf club 11 held in the hands of golfer 16 during a golf swing. FIG. 1 further shows a swing weight 22 used for golfer strength and speed training positioned near the bottom of the shaft of golf club 11. It is contemplated for swing weight 22 to be easily installed on and removed from golf club 11, and replaced as needed by larger, smaller, or multiple swing weights 22. Although it contemplated for swing weight 22 to be placed over the grip 12 of a golf club 11 before apparatus 10 engages grip 12, and for swing weight to also be held in place against the head of golf club 11 by gravity during its use, the configuration for swing weight 22 is not critical and not limited to that shown in FIG. 1. Also, in FIG. 2 the centrally located telescopic arm link shaft 20 has broken lines identifying internal structure and a line A-A extends centrally through telescopic arm link shaft 20 and armband 14, which is used to show the 90-degree rotation of FIGS. 3 and 4 relative to FIG. 2. FIGS. 3 and 4 both show the straps 15 of armband 14 remaining in a closed configuration and the grip attachment member 36 substantially hidden behind golf club grip 12. Further, FIGS. 2 and 4 show elevated positioning of the sleeve bearing 31 that is used for preventing the lower end of inner arm link tube 25 from passing beyond the flange bearing 34 and exiting outer arm link tube 23.

FIGS. 5 and 6 show enlarged views of armband 14 from different vantage points and a portion of the swivel connection 28/40/39/27/41 between armband 14 and the upper end of telescopic shaft 20. FIG. 5 is a back view of the armband 14 used as a part of the most preferred embodiment of the present invention, with a foam pad/insert 43 covering most of its inside surface. The foam pad/insert 43 cushions the upper arm 13 of golfer 16, and preferably extends beyond the top and bottom edges of armband 14. FIG. 5 also shows a preferred two-part adjustable structure for straps 15 and the flexible straps 15 having a preferred hook-and-loop 21 closure so that the connection of armband 14 to the upper arm 13 of golfer 16 can be easily made non-slip. However, other quick-release fasteners are also contemplated for straps 15 in addition to, or as a replacement for, hook-and-loops fasteners 21 as long as they allow armband 14 to become quickly attached to and released from the upper arm 13 of golfer 16. In contrast, FIG. 6 shows a front view of armband 14 with two straps 15 in a closed configuration and without any foam pad/insert 43 visible. In addition, FIG. 6 shows the diagonally-extending upper arm pivot 40 and swivel connector 39 in their preferred positions of use, as well as an optional design 44 that can be used to incorporate cutout areas to reduce weight and/or material cost. The swivel connection described herein between inner arm link tube 25 and armband 14 is a critical feature of the present invention. In contrast, although the configuration and perimeter dimension of armband 14 shown in FIGS. 5 and 6 is preferred, neither is critical. Arm attachment member 14 should have a size and shape that permit it to be reusable, comfortable when worn, readily installed in its usable position on a golfer's upper arm 13, and easily and promptly removed after use. As an alternative, should straps 15 comprise a hook-and-loop fastener 21, the hook-and-loop fastener complementary to it could be secured directly to armband 14. Also, as a further alternative, armband 14 or any strap 15 can be made from material capable of secure and repeatable engagement with a hook fastener 21. FIG. 6 also shows the preferred positioning of the retaining clip 27 that is used to fix upper arm pivot pin 41 into is usable position. The configurations of the retaining clip 27 and upper arm pivot pin 26 used in apparatus 10 are not critical and can be of any size or shape that facilitates the intended swiveling connection between armband 14 and the upper end of telescopic arm link band 20. However, examples of each that can be used with the most preferred embodiment of the present invention are shown respectively in FIGS. 14 and 20.

FIG. 7 shows a cross-section of the telescopic arm link shaft 20 with the lower portion of its inner arm link tube 25 connected to a sleeve bearing 31 within outer arm link tube 23 and an adjustable stop 29 centrally encircling inner arm link tube 25 in a position pre-set by golfer 16 to limit the maximum amount of angle change desired in the upper arm 13 of golfer 16 during a golf swing. An enlargement of the preferred configuration for the adjustable stop 29 used in the most preferred embodiment of the present invention is shown in FIG. 12, with the preferred configuration and positioning for a thumb screw 30 used by golfer 16 to move the location of stop 29 being shown respectively in FIGS. 13 and 3. The configuration of stop 29 and thumb screw 30 can differ from that shown in the accompanying illustrations, as long as the needed stop function with easy adjustability is preserved. FIG. 7 also shows the lower end of inner arm link tube 25 freely slidable and rotatable relative to the outer arm link tube 23, and the bottom end of outer arm link tube 23 having a pivot connection member 24 with a distally located pivot pin hole 33. The grip attachment pivot member 38 shown in FIGS. 8-10 is inserted into the channel/slot 46 (shown in FIG. 19) in pivot connection member 24 and secured within channel/slot 46 via a shoulder screw 37 inserted through the pivot pin hole 33 in pivot connection member 24. The cut-out area 45 shown in FIG. 19 within pivot connection member 24 is for recessed positioning of the head of shoulder screw 37, to avoid abrasion. As shown in FIGS. 2 and 4, but not in FIG. 19 or FIG. 7, it is preferred for the end 32 of pivot connection member 24, which is in an opposed position to pivot hole 33 on the pivot connection member 24, to have both external and internal threads, and for the lower end of inner arm link tube 25 to also be threaded for mating with the internal threads of end 32, and further for the interior surface of outer arm link tube 23 to have a threaded configuration for mating with the external threads on end 32. FIG. 7 also shows a sleeve bearing 31 associated with the lower end of inner arm link 25 and a flange bearing 34 associated with the upper end of outer arm link 23 at the sliding interface of inner arm link tube 25 with outer arm link tube 23 that together create the needed telescoping action between inner arm link tube 25 and outer arm link tuber 23 to permit smooth movement of telescopic arm link shaft 20 with the upper arm 13 of golfer 16 during the angle and rotational change of the lower arm 18 of golfer 16 during a golf swing. Sleeve bearing 31 and flange bearing 34 are both preferably made from plastic materials and assist in the support and smooth gliding and rotation of inner arm link tube 25 relative to outer arm link tube 23, as well as preventing inner arm link tube 25 from becoming separated from outer arm link tube 23. Although not shown, the pivot connection member 24 connected to the bottom end of outer arm link tube 23 may also have a plastic sleeve bearing associated with it for noise reduction. In FIG. 6 the top end of inner arm link tube 25 in the most preferred embodiment of the present invention apparatus 10 has a swiveling connection to armband 14, with the other end inner arm link tube 25 slidably engaged with the outer telescopic arm link shaft 23 via a bonded plastic sleeve bearing 31 and a preferably plastic flange bearing 34 that are used for support and smooth sliding motion, as well as a means of keeping the lower end of the inner arm link tube 25 from exiting outer arm link tube 23. The grip attachment member 36 has an integrated pivot member 38 configured and positioned to assist in providing a pivoting connection to outer arm link tube 23.

FIGS. 8-10 and 21 provide more detail about the structure of the preferred configuration for the pivot 24/38 connection between telescopic arm link shaft 20 and a golf club grip 2. FIGS. 8-10 each show enlarged views of the grip attachment member 36 and grip attachment pivot member 38, as well as the curved extension 35 connecting them to one another. In addition, FIG. 21 shows one example of preferred positioning for grip attachment member 36 relative to the grip 12 of a golf club 11. FIG. 8 is an end view showing the accurate structure of grip attachment member 36 that is configured to closely follow the curvature of a golf club grip 12. FIG. 8 also shows the near end of grip attachment member 36 connected via a curved extension 35 to grip attachment pivot member 38. When grip attachment member 36 becomes engaged with a golf club grip 12, curved extension 35 and grip attachment pivot member 38 become positioned adjacent to the proximal/grip 12 end of a golf club 11 or other sports implement (not shown). In contrast, FIG. 9 is a top view of the grip attachment member 36 in FIG. 8 and shows a non-skid surface texture 42 on the inside concave surface of grip attachment member 36. As typically preferred, when grip attachment member 36 is used between the hands of golfer 16 and a golf club grip 12, the hands of golfer 16 and the centrifugal force created during a golf swing secure grip attachment member 36 closely against golf club grip 12, with the non-skid surface texture 42 further preventing slippage during the golf swing. The non-slip texture 42 may be provided integral texture formed during manufacture, applied tape or other adhesive-backed material, a sprayed coating, or other common means of providing surface texture. Further, FIG. 10 is a side view of grip attachment member 36, curved extension 35, and grip attachment pivot member 38 shown in FIG. 8, with FIG. 21 showing the relative positioning of a golf club 11 and its grip 12 to grip attachment member 36 in the most preferred embodiment of the present invention. FIG. 21 shows grip attachment member 36 engaging less than one-half of the circumference of golf club grip 12 and not extending as far as the interface between golf club grip 12 and golf club 11. However, it is to be understood that the relative dimensions and positioning of golf club grip and grip attachment member 36 may be different from that shown in FIG. 21.

FIG. 11 shows a golfer 16 using apparatus 10 comprising an armband 14, foam pad/insert 43, telescopic arm link shaft 20, and grip attachment member 36. In FIG. 11, apparatus 10 is connected to the grip 12 of a golf club 11 held in the hands of golfer 16. Further, armband 14 is connected to a golfer's upper arm 13 (above the elbow) and the hands of golfer 16 are both holding golf club grip 12 in a position poised for a golf swing. The telescopic arm link shaft 20 connected to armband 14 extends substantially parallel to the golfer's upper arm 13 in a downwardly direction toward the golf club grip 12. The telescoping action and free rotation of the inner arm link tube 25 of the telescopic arm link shaft 20 relative to outer arm link tube 23 permits golfer 16 to make the necessary angle and rotational adjustments during a golf swing to allow the hands of golfer 16 to achieve a smooth follow through, while maintaining a constant alignment of the upper arm 13 of golfer 16 with the golf club 11. The constant alignment of the golfer's upper arm 13 and the golf club face 19 is critical to a quality golf swing. The golf club face 19 is traveling 80 to 120 miles per hour when it strikes golf ball 17. It is impossible to re-align golf club face 19 relative to golf ball 17 once it is out of alignment at those speeds. The invention will permit a smooth transition for the angle and rotational changes needed in the lower arm 18 (below the elbow) of golfer 16 during a golf swing, while the golf club 11 held by golfer 16 is maintained in constant alignment throughout the golf swing with the upper arm 13 of golfer 16 to condition the upper arm 13, lower arm 18, wrist, and hands of golfer 16 to the proper sequence of movement, rhythm, and timing of an efficient golf swing. Golfer 16 may practice his or her swing without hitting golf balls 17, knowing that the proper timing and mechanics of the swing are still being conditioned, or in the alternative, a golf ball 17 may be used. Further, the upper arm 13, the lower arm 18, wrist, and hand movement are all conditioned in concert by use of apparatus 10, so that the learning involved is direct and not theoretical. In addition, as shown in FIG. 1, apparatus 10 or golf club 11 can be weighted with one or more swing weights 22 for strength and speed training of golfer 16, so that proper swing mechanics can be reinforced while golfer 16 becomes conditioned. Apparatus 10 can be secured against a golf club grip by the hands of golfer 16, connected to any of the golfer's own golf clubs 11 and removed thereafter without any damage or permanent alteration thereto via one or more securely attachable but quickly released clamp (not shown), or for time savings, convenience, or other preference of golfer 16, apparatus 10 can be permanently attached to a golf club 11 reserved for swing practice.

The advantages of the present invention are:

(a) constant practice with the apparatus 10, while hitting (or not striking) a golf ball 17, will condition the golfer 16 to the proper coordinated sequence of upper arm 13, lower arm 18, wrist, and hand actions necessary to efficiently swing a golf club 11;

(b) a golfer 16 may use apparatus 10 with any of the golfer's own golf clubs 11 by simply securing apparatus 10 against a golf club grip 12 using the golfer's own hands;

(c) after use, apparatus 10 is disengaged from a golf club grip without any damage or permanent alteration to apparatus 10, golf club grip 12, or golf club 11;

(d) apparatus 10 conditions all upper arm 13, lower arm 18, wrist, and hand movement of golfer 16 in concert, so that the learning of a quality swing is direct and not theoretical;

(e) apparatus 10 can be quickly and easily engaged and disengaged from a golf club 11 and the upper arm 13 of golfer 16;

(f) apparatus 10 is light and small, and it can be used with a swing weight 22 for strength and speed training, which would insure proper swing mechanics while conditioning;

(g) a golfer 16 may hit shots with apparatus 10 connected, or practice his swing without hitting golf balls knowing that the proper timing and mechanics are still being conditioned;

(h) apparatus 10 may be permanently attached to a golf club 11 used solely for practice;

(i) apparatus 10 may be removed as golfer 16 progresses, and brought back into use at any time further conditioning is thought to be necessary;

(j) apparatus 10 can be easily connected with appropriate adaptors (not shown) to athletic instruments used in other sports that function at least in part as a result of a swinging motion.

(k) via its stop 29 the apparatus is adjustable and permits angle changes; and (l) the apparatus holds the golfer's upper arm 13 and the golf club 11 held in the hands of golfer 16 in absolute alignment during a golf swing;

The learning principal of the present invention relates to the golfer 16 and golf club 11 as a set of training wheels relates to a cyclist and a bicycle (not shown). Proper practice with the training aid apparatus 10 will condition golfer 16 to both the mechanics and the "feel" of an efficient golf swing, which will carry over when the apparatus 10 is not being used. However, the training apparatus 10 may be readily used again at any time that further conditioning is desired.

Finally, FIGS. 12-21 show enlargements of pivoting, swivel, and rotation-facilitating components used in the most preferred embodiment of the present invention that were not identified in sufficient detail in other illustrations for a complete understanding of their structure. All of the components shown in FIGS. 12-20 are merely representative, and alternative components with differing size and/or configuration can be substituted as long as the needed pivoting, swivel, or rotational motion is maintained. FIG. 12 is a perspective view of the preferred adjustable stop 29 used on the inner arm link tube 25 to limit the maximum amount of the angle change desired between the lower arm 18 of a golfer 16 and the golf club 11 held in the hands of golfer 16 during a golf swing. Inner arm link tube 25 extends through the aperture 48 shown in adjustable stop 29, while the thumb screw 30 shown in FIG. 13 is inserted into fastener hole 47. FIG. 13 is a side view of the preferred thumb screw 30 used to tighten stop 29. The configuration of thumb screw 30 is not limited to that shown in FIG. 13, as long as it remains tight during use to hold stop 29 in place on inner arm link tube 25, yet it is also easily loosened and tightened by hand when movement of stop 29 along inner arm link tube 25 is required. FIG. 14 is a side view of a preferred retaining clip 27 used to secure the upper arm attachment pin 41 in place and assist in providing a swivel connection between the upper arm connector with bearing connection 39 and armband 14. FIG. 15 is a side view of a preferred flange bearing 34 used where the inner arm link tube 25 enters the outer arm link tube 23. FIG. 16 is a side view of the upper arm connector with bearing connection 39 and the upper arm pivot 40 diagonally extending from one face thereof. FIG. 16 also shows the pivot pin hole 49 through which the upper arm pivot pin 41 in FIG. 20 is inserted for connecting armband 14 for swivel movement relative to the upper end of telescopic arm link shaft 20. A bore 50 through the distal end of upper arm pivot 40 is used in combination with the pivot pin hole 33 in the inner arm link tube pivot member 28 to connect upper arm pivot 40 to inner arm link tube pivot member 28. FIG. 17 is a side view of a preferred pivot pin 26 used to secure the upper end of the inner arm link tube 25 to armband 14. The shoulder screw 37 that secures the grip attachment pivot member 38 to the pivot pin hole 33 in the outer arm link tube pivot member 24 at the lower end of the outer arm link tube 23, may exhibit a configuration similar to that shown for the upper arm pivot pin 26 in FIG. 17. FIG. 18 is a side view of the preferred sleeve bearing 31 attached to the lower end of inner arm link tube 25 and used to keep the lower end of the inner arm link tube 25 from exiting the top end of the outer arm link tube 23. FIG. 19 is a side view of the preferred pivot member 24 and its proximal end 32 used to provide a pivoting connection for the grip attachment pivot member 38 to the telescopic arm link shaft 20. The inner arm link tube pivot member 28 used for connection of the upper arm pivot 40 to the telescopic arm link shaft 20 may exhibit a configuration similar to that shown for the pivot member 24 in FIG. 19. FIG. 19 also shows the insert or cut-out area 45 where the head of shoulder screw 37 can be protected from abrasion, and a channel 46 within which grip attachment pivot member 38 is secured to assist in creating the pivoting connection between grip attachment member 36 and the lower end of outer arm link tube 23. FIG. 20 is a side view of the preferred upper arm pivot pin 41 used with retaining clip 27 to secure the upper arm connector with bearing connection 39 to the armband 14 and provide a 360-degree swiveling connection for armband 14 in all directions substantially around and above the top end of upper arm link tube 25.

What is claimed is:

1. A swing training device adapted for instructing and improving the swinging of a sports implement, and which is secured between the upper arm of a sports player and the grip end of the sports implement, said device comprising:

a telescopic member having an inner arm link tube and an outer arm link tube, with said inner arm link tube having freely sliding and rotational movement relative to said outer arm link tube, said telescopic member also configured and positioned for telescopic movement along the inside portion of the upper arm of a sports player and having a first end associated with said inner arm link tube and a second end associated with said outer arm link tube;

an armband having a swivel connection to said first end of said telescopic member; and grip attachment means adapted for pivoting connection to said second end of said telescopic member, said grip attachment means also adapted for fixed association with the grip end of a sports implement during the time that the implement is held by a sports player and swung, so that when said armband is secured around the player's upper arm in a position allowing telescopic movement along the inside portion of the connected upper arm, and when said grip attachment means is also placed in close association with the grip end of the sports implement at a location on the sports implement that consequently establishes an angle between the player's connected upper arm and the sports implement while it is held in the player's hands, then throughout a swing of the sports implement that concomitantly swings said training device, said telescopic member, said swivel connection, and said pivoting connection all work in concert to provide smooth angle and rotational changes of the player's lower arm that produce efficient swinging movement, while absolute alignment of the golfer's connected upper and lower arm is maintained relative to the sports implement, thereby conditioning the player's arm, wrist, and hands to the proper sequence of movements, rhythm, and timing of an efficient swing.

2. The device of claim 1 wherein said telescopic member further comprises stop means adjustably connected to said inner arm link tube.

3. The device of claim 1 wherein said grip attachment means is selected from a group consisting of grip attachment members configured for permanent attachment to a sports implement, grip attachment members configured for temporary attachment to a sports implement, grip attachment members configured for easily releasable attachment to a sports implement, grip attachment members configured for easily releasable and non-damaging attachment to a sports implement, grip attachment members configured for engaging a sports implement through use of a textured surface, and grip attachment members configured for engaging a sports implement through use of a high-friction surface.

4. The device of claim 1 wherein said armband further comprises at least one easily connectable and easily releasable strap.

5. The device of claim 4 wherein said at least one easily connectible and easily releasable strap further comprises at least one quick-release fastener.

6. The device of claim 1 further comprising at least one sleeve bearing configured for assisting smooth movement between said inner arm link tube and said outer arm link tube.

7. The device of claim 6 further comprising at least one flange bearing configured for assisting smooth movement between said inner arm link tube and said outer arm link tube.

8. The device of claim 1 further comprising at least one flange bearing configured for assisting smooth movement between said inner arm link tube and said outer arm link tube.

9. The device of claim 1 wherein said swivel connection further comprises a diagonally-extending upper arm pivot member.

10. The device of claim 9 wherein said swivel connection further comprises an upper arm connector with a bearing connection.

11. The device of claim 1 wherein said swivel connection further comprises an upper arm connector with a bearing connection.

12. The device of claim 1 wherein said swivel connection further comprises a pivot pin and a retaining clip configured for holding said pivot pin in a fixed location.

13. The device of claim 1 wherein said grip attachment means further comprises a carved extension.

14. The device of claim 1 wherein said grip attachment means further comprises an arcuate engagement surface.

15. The device of claim 1 further comprising at least one swing weight configured and positioned to provide speed and strength training while said efficient swinging movement takes place.

16. The device of claim 1 further comprising at least one comfort-enhancing insert associated with said armband.

17. The device of claim 16 wherein said at least one insert is flexible.

18. The device of claim 1 wherein said swivel connection further comprises at least one inner arm link pivot pin.

19. The device of claim 18 wherein said pivoting connection further comprises at least one shoulder screw.

20. The device of claim 1 wherein said pivoting connection further comprises at least one shoulder screw.

* * * * *